US006375169B1

(12) United States Patent
McCraw et al.

(10) Patent No.: US 6,375,169 B1
(45) Date of Patent: Apr. 23, 2002

(54) MATTRESS SPRING CUSHION ASSEMBLY WITH COMBINATION OF RIGHT-HAND AND LEFT-HAND SPRING UNITS

(75) Inventors: Kevin N. McCraw, Micaville, NC (US); Stuart Spiller, Sheboygan, WI (US)

(73) Assignee: Hickory Springs Manufacturing Company, Hickory, NC (US)

( * ) Notice: Subject to any disclaimer, the term of this patent is extended or adjusted under 35 U.S.C. 154(b) by 5 days.

(21) Appl. No.: 09/627,621

(22) Filed: Jul. 28, 2000

(51) Int. Cl.[7] ..... F16F 13/00; F16F 15/02

(52) U.S. Cl. ..... 267/75; 267/93; 267/97; 5/248

(58) Field of Search ..... 5/248, 256, 716, 5/246; 267/80, 91, 93, 97, 100, 101, 75, 89, 142

(56) References Cited

U.S. PATENT DOCUMENTS

| | | | | | |
|---|---|---|---|---|---|
| 111,974 | A | * | 2/1871 | Rich | 5/267 |
| 258,595 | A | * | 5/1882 | Phillips | 5/266 |
| 279,188 | A | * | 6/1883 | Rodebaugh | 5/617 |
| 1,089,976 | A | * | 3/1914 | Shannon | 5/252 |
| 1,596,273 | A | | 8/1926 | Karr | |
| 1,744,389 | A | | 1/1930 | Karr | |
| 1,798,885 | A | | 3/1931 | Karr | |
| 1,805,817 | A | * | 5/1931 | Foster | 5/275 |
| 1,879,172 | A | | 9/1932 | Gail | |
| 1,887,058 | A | | 11/1932 | Karr | |
| 1,895,429 | A | | 1/1933 | Foster | |
| 1,897,309 | A | | 2/1933 | Karr | |
| 1,963,055 | A | | 6/1934 | Powers | |
| 1,982,426 | A | | 11/1934 | Goethel | |
| 2,292,792 | A | * | 8/1942 | Parker et al. | 267/100 |
| 2,374,850 | A | | 5/1945 | Wunderlich | |
| 2,516,566 | A | | 7/1950 | Hager | |
| 2,567,520 | A | | 9/1951 | McInerney et al. | |
| 2,581,686 | A | | 1/1952 | McRoskey | |
| 2,631,840 | A | | 3/1953 | Bugenhagen | |
| 2,688,757 | A | | 9/1954 | Bronstien | |
| 3,052,460 | A | | 9/1962 | Nachman, Jr. | |
| 3,657,749 | A | | 4/1972 | Norman | |
| 3,716,874 | A | | 2/1973 | Thomas, Jr. | |
| 4,004,304 | A | | 1/1977 | Kane | |
| 4,053,956 | A | | 10/1977 | Higgins | |
| 4,095,297 | A | | 6/1978 | Thomas, Jr. | |
| 4,112,726 | A | | 9/1978 | Adams et al. | |
| 4,324,011 | A | * | 4/1982 | Cavaler | 5/248 |
| 4,358,097 | A | | 11/1982 | Zapletal et al. | |
| 4,426,070 | A | | 1/1984 | Garceau et al. | |
| 4,445,547 | A | | 5/1984 | Aronson | |
| 4,475,724 | A | | 10/1984 | Hancock | |
| 4,488,712 | A | | 12/1984 | Higgins | |
| 4,609,186 | A | | 9/1986 | Thoenen | |
| 4,639,957 | A | | 2/1987 | Wells et al. | |
| 4,686,753 | A | | 8/1987 | Zapletal et al. | |

(List continued on next page.)

FOREIGN PATENT DOCUMENTS

| | | |
|---|---|---|
| GB | 0 937 644 | 9/1963 |
| GB | 1104844 | 3/1968 |
| GB | 2 143 731 A | 7/1983 |

*Primary Examiner*—Christopher P. Schwartz
*Assistant Examiner*—Devon Kramer
(74) *Attorney, Agent, or Firm*—Kennedy Covington Lobdell & Hickman, LLP

(57) ABSTRACT

A spring cushion assembly, particularly for mattresses, comprises a plurality of spring coils aligned with one another in parallel linear spring coil rows and parallel linear spring coil columns perpendicular to the spring coil rows, each spring coil being of a configuration producing a tendency to incline laterally when compressed, with each spring coil row and each spring coil column comprising spring coils oriented relative to one another to incline in opposing directions for counteracting the tendency of the spring coils to incline.

21 Claims, 7 Drawing Sheets

U.S. PATENT DOCUMENTS 4,699,362 A 10/1987 Krakauer
4,705,079 A 11/1987 Higgins
4,726,572 A 2/1988 Flesher et al.
4,766,624 A 8/1988 Yates et al.
4,771,494 A 9/1988 Zapletal et al.
4,781,360 A 11/1988 Ramsey
4,790,038 A 12/1988 Ikeda
4,817,924 A 4/1989 Thoenen
4,867,423 A 9/1989 Marsh
4,905,333 A 3/1990 Scott
4,960,267 A * 10/1990 Scott ..... 267/91
5,105,642 A 4/1992 Mohr
5,139,054 A * 8/1992 Long et al. ..... 140/3 CA
5,197,155 A 3/1993 Ogle et al.
5,584,083 A 12/1996 Ramsey et al.
5,649,332 A * 7/1997 Wells et al. ..... 5/727
5,669,093 A 9/1997 Ogle et al.
5,713,400 A 2/1998 Wells et al.
5,761,784 A 6/1998 Ogle et al.
5,987,678 A 11/1999 Ayers
6,260,223 B1 * 7/2001 Mossbeck et al. ..... 5/720
6,272,706 B1 * 8/2001 McCune et al. ..... 5/720

* cited by examiner

MATTRESS SPRING CUSHION ASSEMBLY WITH COMBINATION OF RIGHT-HAND AND LEFT-HAND SPRING UNITS

BACKGROUND OF THE INVENTION

The present invention relates generally to cushions assembled with a plurality of spring coils and, more particularly, to such a spring cushion assembly suitable for use in a mattress comprised of a combination of spring coils which oppose one another either by opposing inclinational or rotational tendencies, e.g., right-hand and left-hand spring coils.

Spring cushion assemblies of the aforementioned type are well known within the furniture industry for use as so-called innerspring constructions for mattresses as well as other forms of upholstered furniture. Characteristically, such cushion assemblies comprise a plurality of resiliently compressible spring coils arranged in adjacent side-by-side disposition in a selected systematic array, most commonly in linear rows and columns, and connected together, e.g., by metal bands, clips, strings, helical wires, or the like, to form an integrated spring cushion assembly. Such spring cushion assemblies used for mattresses also commonly include border wires, which may be continuous or discontinuous, forming a perimeter outwardly about and connected to the upper and lower end turns of the outermost spring coils.

The types, configurations and constructions of the spring coils utilized in such spring cushion assemblies are quite diverse and may differ, for example, according to the type and size (gauge) of the wire from which the spring coils are made, whether the upper and lower end turns of each spring coil are closed (typically by knotting the terminal wire ends to a medial point along the end coil) or open (i.e., the terminal wire ends are left free and unconnected), the number of intervening coil turns between the opposite end turns (which may be a whole number of turns or may include a one-half coil turn), and whether the spring coils are separate wire units or part of a common length of wire, as with so-called continuous coil spring units (see, e.g., U.S. Pat. Nos. 4,053,956 and 4,358,097).

In producing any given spring cushion assembly, the selection among these various characteristics for the spring coils is made according to considerations of the desired spring characteristics for the cushion assembly (e.g., spring compressibility, strength, etc.), cost, structural stability and rigidity of the cushion assembly, etc. For example, spring coils whose end turns are closed by knotting tend to utilize more wire and to be more expensive to produce than open-ended spring coils. However, open-ended spring coils constructed with a full number of coil turns exhibit a pronounced tendency to incline laterally and to rotate in the direction of their hand (clockwise for right-hand coils and counterclockwise for left-hand coils) when compressed. Hence, when spring cushion assemblies are made of open-ended spring coils, it is not uncommon to utilize spring coils each of a right-hand coiling in each alternating row of spring coils and to utilize spring coils each of a left-hand coiling in each intervening row of spring coils, because the oppositely handed spring coils will tend to incline and rotate in opposite directions under compression and thereby will tend to counter balance one another and enhance the lateral stability of the overall cushion spring assembly.

SUMMARY OF THE INVENTION

It is accordingly an object of the present invention to provide further improvements in spring cushion assemblies of the aforementioned type and, in particular, to provide a spring cushion assembly with more enhanced lateral stability against spring coil incline. and rotation than in the prior art.

Briefly summarized, the present invention addresses the foregoing objective by providing a spring cushion assembly which comprises a plurality of spring coils each of which is of a configuration producing a tendency to incline laterally when compressed. According to the present invention, the plurality of spring coils are aligned with one another in parallel linear spring coil rows and parallel linear spring coil columns perpendicular to the spring coil rows, with each spring coil row and each spring coil column having spring coils oriented relative to one another to incline in opposing directions for counteracting the tendency of the spring coils to incline.

Various embodiments of this basic construction are contemplated. For example, in one preferred embodiment, the spring coils comprise right-hand and left-hand spring coils alternating with one another within each row and each column. This embodiment offers the advantage that the oppositely handed spring coils counteract their respective tendencies to rotate oppositely as well as to incline oppositely. Alternatively, however, it is also contemplated that a spring cushion assembly in accordance with the present invention may be formed entirely of spring coils of the same hand by orienting alternating and intervening spring coils within each row and column in opposing orientations, e.g., rotated one hundred eighty degrees from one another, whereby each spring coil tends to incline oppositely to each adjacent spring coil so as to effectively counteract each other. It is further contemplated that the invention could be embodied in a spring cushion assembly made of continuous coil units by forming the alternating and intervening spring coils in each common length of wire to be of opposing orientations or opposing hands.

In many possible embodiments, the spring coils will be of the open-ended type having open upper and lower end turns, and often will have a full number of coil turns therebetween. Many embodiments will also have multiple helical connector wires extending between adjacent spring columns for connecting the respective upper and lower end coils thereof and with upper and lower perimeter border wires disposed outwardly about the spring coils and connected to the upper and lower end turns of the outermost spring coils, thereby for integrating the spring coils together. Preferably, the spring cushion assembly is adapted for use as a mattress spring assembly.

DETAILED DESCRIPTION OF THE PREFERRED EMBODIMENT

Figure 1:
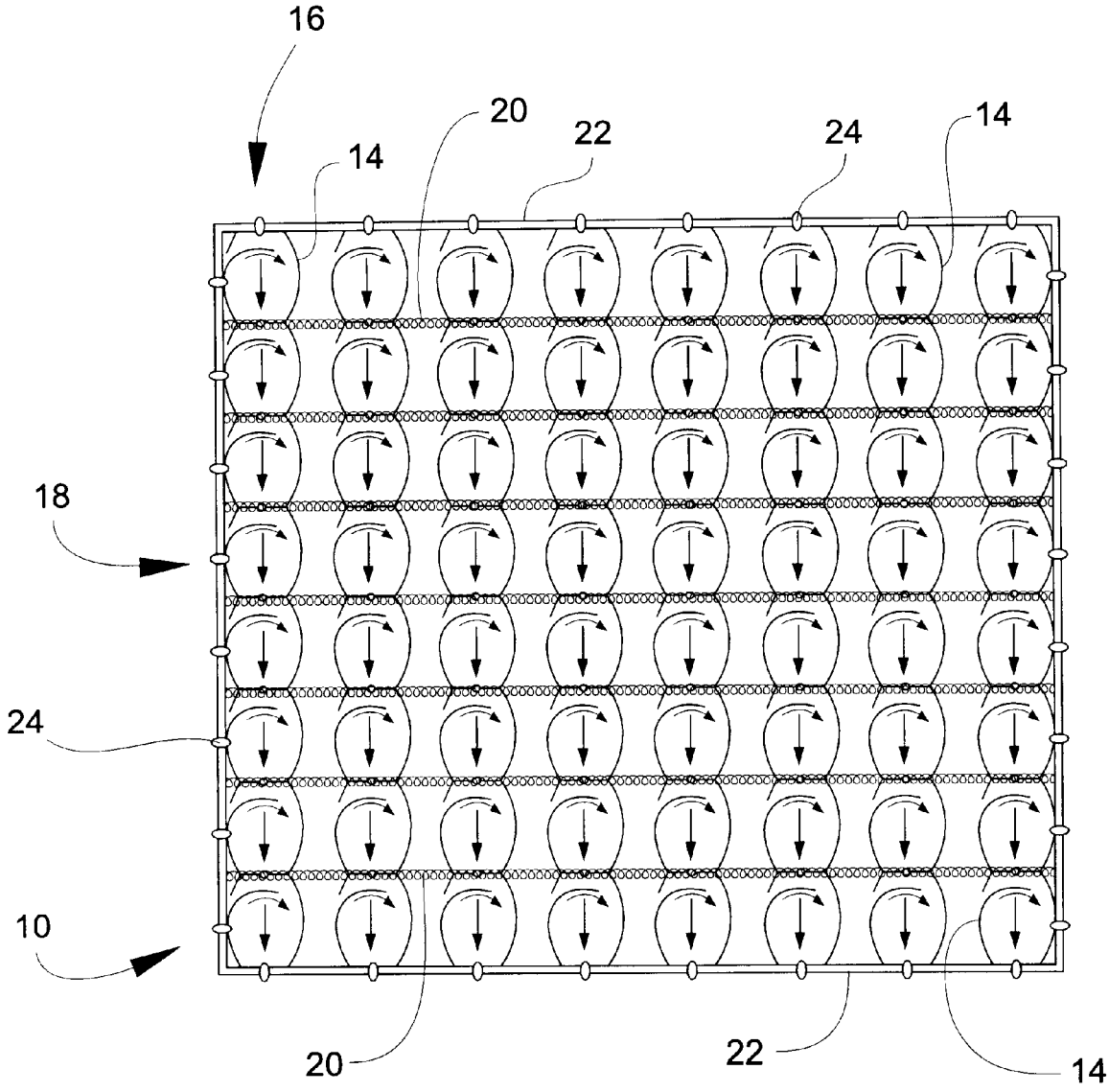
Fig. 1 (PRIOR ART)
FIG. 1 is a schematic top plan view of a prior art mattress spring cushion assembly comprised entirely of spring coils of a common hand and in a common orientation.
Figure 2:
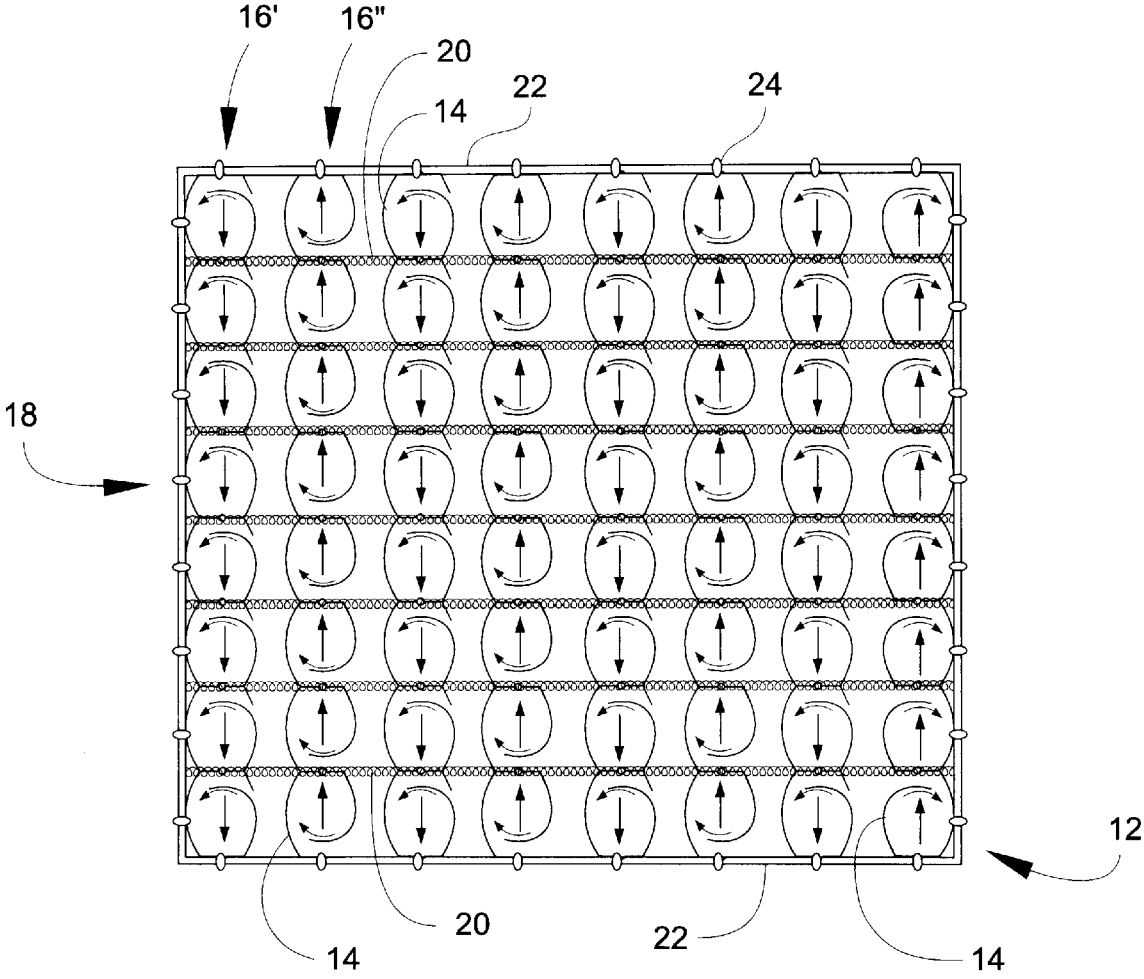
Fig. 2 (PRIOR ART)
FIG. 2 is another schematic top plan view, similar to FIG. 1, of a prior art mattress spring cushion assembly comprised of alternating rows each entirely of right-hand or left-hand spring coils in a common orientation.

Referring now to the accompanying drawings and initially to FIGS. 1 and 2, prior art mattress spring cushion assemblies of the types described above are depicted generally at 10 and 12, respectively. Each mattress spring cushion assembly 10, 12 comprises a plurality of open-ended spring coils 14 arranged in adjacent side-by-side relation in parallel linear rows 16 and parallel linear columns 18 perpendicular to the rows 16. The spring coils 14 in each spring assembly 10, 12 are of the open-ended type with open upper and lower end turns 14', 14" with one or more helical turns 14'" extending integrally therebetween, as more fully depicted in FIGS. 3 and 4. The spring coils 14 are disposed with their respective upper and lower end turns 14', 14" in co-planar relationship with one another, the upper and lower end turns of adjacent columns 18 being connected via interengagement within the spirals of elongate helical connector wires 20 each extending the full length of the respective spring assembly 10, 12. Each spring assembly 10, 12 additionally incorporates upper and lower rectangular border wires 22, typically of a much heavier gauge than the wires of the spring coils 14 and the helical connector wires 20, the border wires 22 extending about the perimeter of the array of spring coils 14 respectively adjacent the upper and lower end turns 14', 14" of the outermost rows 16 and columns 18 and connected thereto by metal bands or clips 24.

In the prior art spring assembly 10 of FIG. 1, each spring coil 14 in each row 16 and column 18 is of the same hand with all spring coils disposed in the same orientation as one another. As illustrated, the spring assembly 10 is made entirely of right-hand spring coils wherein the intermediate coil turns 14'" are formed with a right-hand spiral, i.e., when viewed axially from the upper end turn 14' downwardly to the lower end turn 14", the turns 14'" of the spring coil spiral in a clockwise direction, as best seen in the perspective view of a single right-hand spring coil 14 in FIG. 3. As will additionally be seen in FIG. 3, the spring coil 14 thereof has three complete intervening coil turns 14'", whereby the upper and lower end turns 14', 14" open laterally oppositely from one another. Of course, the spring assembly 10 could alternatively be comprised entirely of open-ended left-hand spring coils 14 such as shown in FIG. 4. Like the right-hand spring coil 14 of FIG. 3, the left-hand spring coil 14 of FIG. 4 also has three complete intervening coil turns 14'" between its open upper and lower end turns 14', 14".

Figure 3A:
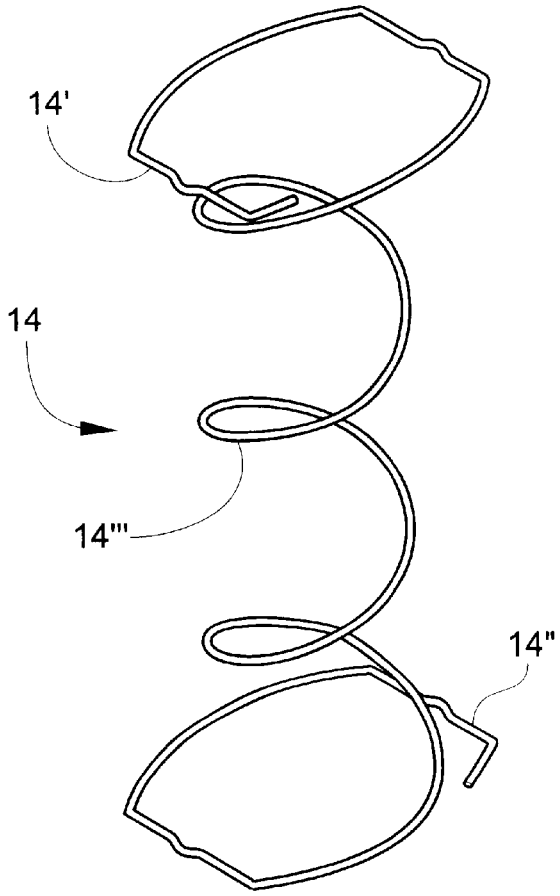
FIG. 3A is a perspective view of a single open-ended right-hand spring coil in relaxed uncompressed condition.
Figure 3B:
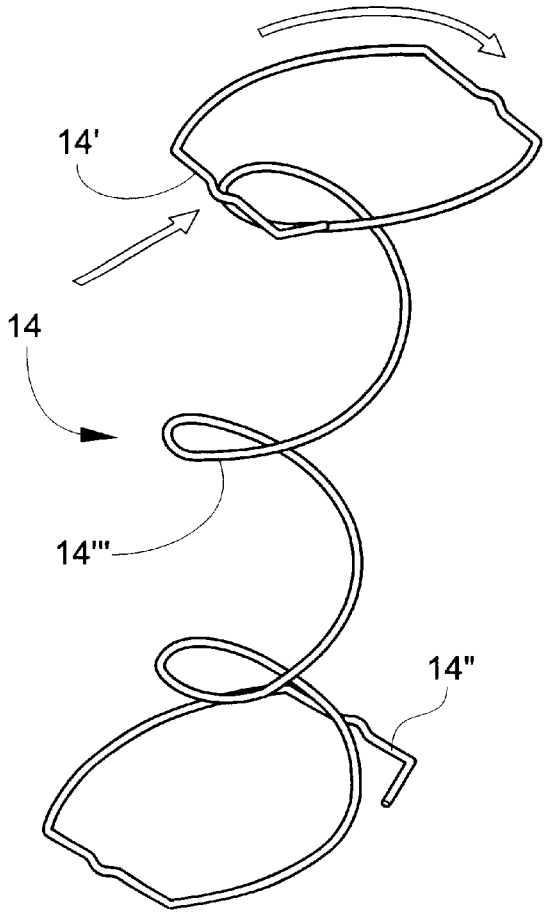
FIG. 3B is another perspective view of the right-hand spring coil of FIG. 3A in compressed condition.
Figure 4A:
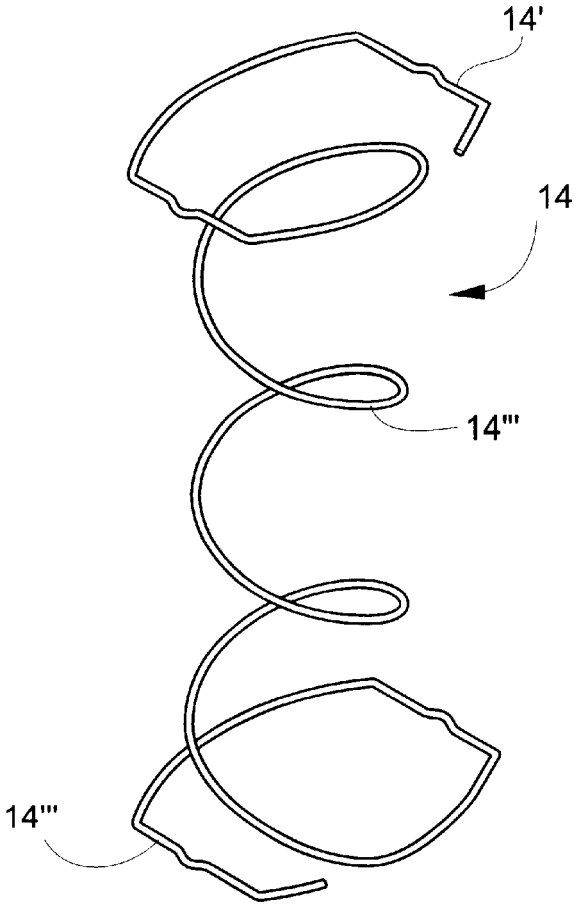
FIG. 4A is another perspective view, similar to FIG. 3, of a single open-ended left-hand spring coil in relaxed uncompressed condition.
Figure 4B:
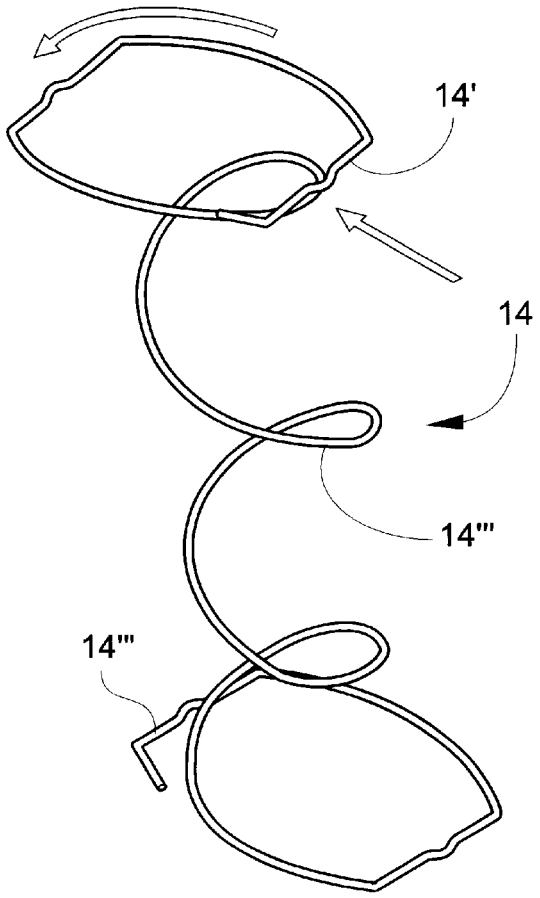
FIG. 4B is another perspective view of the left-hand spring coil of FIG. 4A in compressed condition.
Figure 5A:
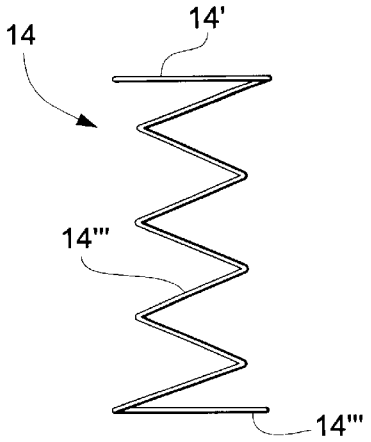
FIGS. 5A and 5B are schematic side elevational views respectively depicting the right-hand spring coil of FIG. 3 in uncompressed and compressed states and illustrating the tendency of such spring coil to incline laterally when compressed.
Figure 5B:
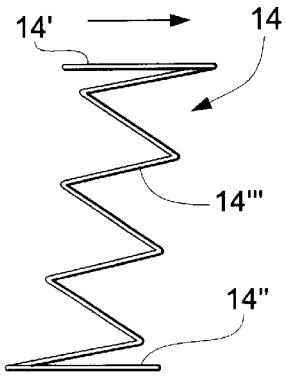
Figure 6A:
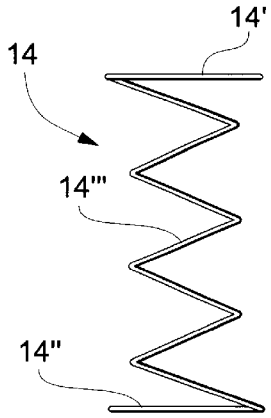
FIGS. 6A and 6B are schematic side elevational views, similar to FIGS. 5A and 5B, depicting respectively the left-hand spring coil of FIG. 4 in uncompressed and compressed states and illustrating the tendency of such spring coil to incline laterally when compressed.
Figure 6B:
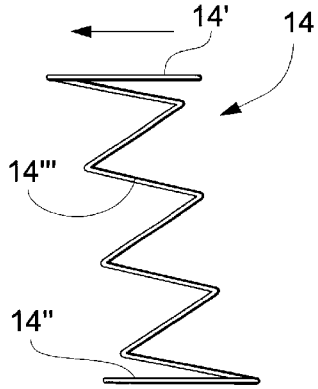

As persons skilled in the relevant art will readily recognize and understand, such spring coils 14 of the type of FIGS. 3 and 4 have a pronounced tendency to incline laterally (in opposite directions depending upon the hand of the spring unit) when compressed, as indicated by the directional arrows in FIGS. 3B and 4B and as depicted comparatively for a right-hand spring coil in FIGS. 5A and 5B and, similarly, for a left-hand spring coil in FIGS. 6A and 6B. Likewise, such spring coils also exhibit the inherent tendency to rotate in the direction of the hand of the spring coil when compressed, i.e., a right-hand spring coil will tend to rotate clockwise when compressed and a left-hand spring coil will tend to rotate counterclockwise when compressed, as indicated by the directional arrows in FIGS. 3B and 4B. Hence, as is known, prior art mattress spring cushion assemblies of the type of the assembly 10 of FIG. 1, whether made entirely of right-hand spring coils or left-hand spring coils, exhibit the disadvantageous tendency for the entire assembly to incline and twist in a common direction when compressed, as depicted representatively by the directional arrows in FIG. 1, which impairs the lateral stability of the spring assembly 10.

The prior art spring cushion assembly 12 of FIG. 2 was intended to address the problem of lateral stability experienced by the spring assembly 10 of FIG. 1 by providing alternating rows 16', 16" of left-hand and right-hand spring coils 14, the intent of which is for the oppositely handed spring coils 14 of adjacent rows 16', 16" to tend to counteract one another by the respective spring rows inclining and twisting in opposing directions. While the spring cushion assembly 12 of FIG. 2 provides some improvement in overall lateral stability in comparison to the spring cushion assembly 10 of FIG. 1 none of the individual spring coils 14 act in direct opposition to one another. Thus, there remains the tendency of the left-hand and right-hand spring coils 14 in a common row 16', 16", respectively, to incline and twist together in a common direction, as represented by the directional arrows in FIG. 2, with the respective spring rows 16', 16" acting in opposition to one another only indirectly via the connecting helical wires 20. As a result, the spring assembly 12 still exhibits an undesirable degree of lateral instability in the widthwise direction of the rows 16.

Figure 7:
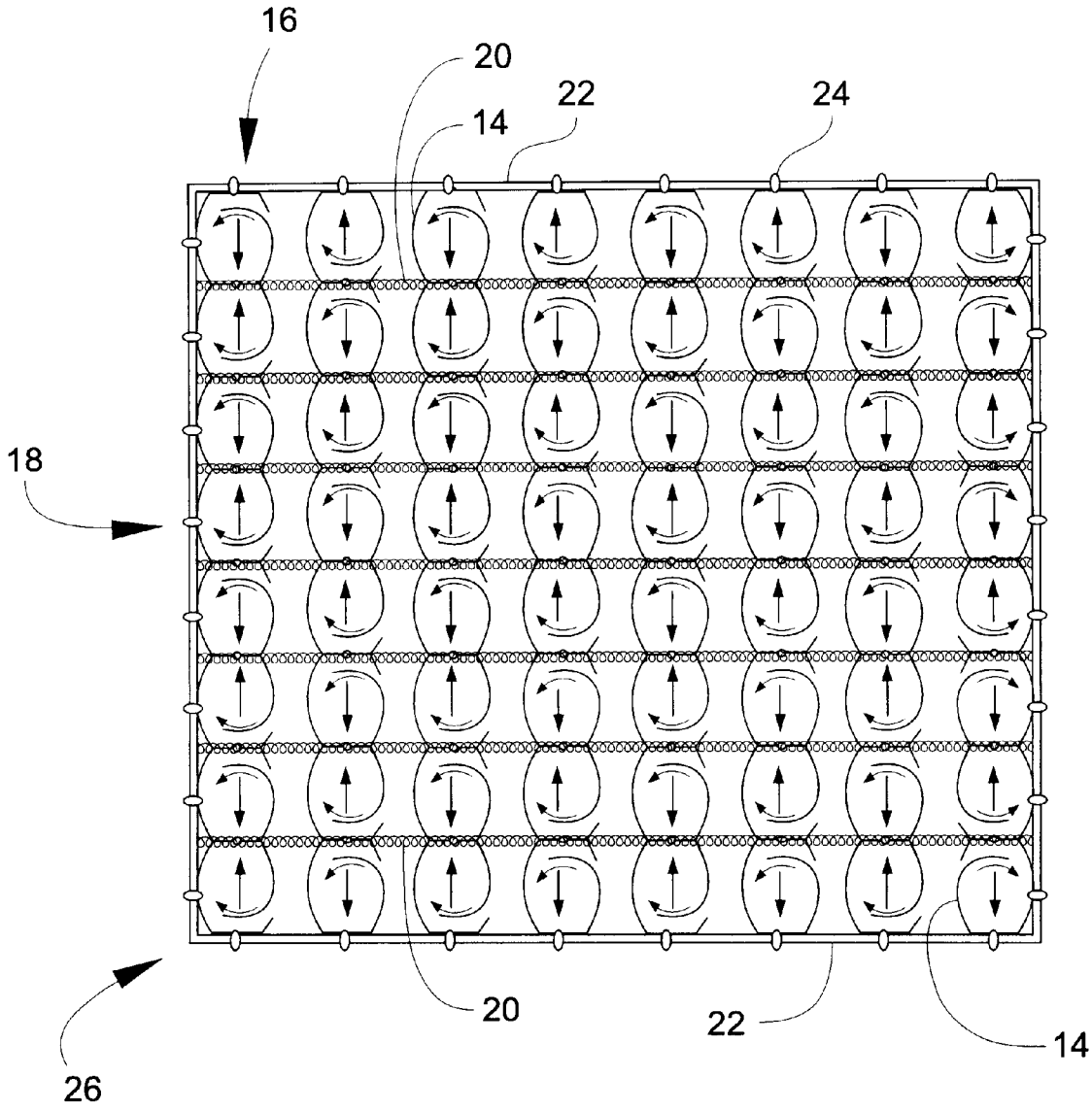
FIG. 7 is a schematic top plan view of a mattress spring cushion assembly according to a preferred embodiment of the present invention wherein right-hand and left-hand spring coils alternate with one another within each column and row of the spring coils.

With reference now to FIG. 7, a preferred embodiment of the novel spring cushion assembly of the present invention is indicated generally at 26 in a schematic top plan view similar to that of FIGS. 1 and 2. The spring assembly 26 in the embodiment of FIG. 7 is particularly adapted for use as the so-called innerspring assembly of a mattress, but as persons skilled in the art will recognize and understand, the principles of the construction of the spring assembly 26 are equally applicable to other cushion spring assemblies formed of multiple integrated spring coils. Like the spring assemblies 10, 12 of FIGS. 1 and 2, the spring assembly 26 also comprises plural spring coils 14 arranged in widthwise rows 16 and lengthwise columns 18, with the upper and lower end turns 14', 14" joined laterally by helical connector wires 20 and with upper and lower border wires 22 connected by bands or clips 24 to the upper and lower end turns 14', 14-" of the spring coils 14 of the two outermost rows 16 and columns 18. The spring assembly 26 is distinguished from each of the spring assemblies 10 and 12 in that the spring coils 14 within each row 16 alternate between left-hand and right-hand spring coils 14, with the hand of the spring coils of each row 16 being staggered relative to the spring coils 14 of adjacent rows 16 such that the spring coils 14 within each column 18 also alternate between left-hand and right-hand spring coils (the only exception being one end row of spring coils 14 which is turned such that the open side of each upper and lower end turn 14', 14" of the spring coils 14 within such row face inwardly of the array of spring coils 14 to better facilitate joinder to the border wire 22).

In this manner, it will be seen that each individual spring coil 14 within the spring assembly 26 is of a hand opposite that of each adjacent spring coil 14 on each opposite side thereof within the same row 16 and each adjacent spring coil 14 on each opposite side thereof within the same column 18. By this arrangement of the spring coils 14, the spring coils 14 act in direct opposition to one another both lengthwise along the columns and widthwise across the rows 16, as depicted in FIG. 7 and as also indicated by the arrows in FIG. 8, to counteract their individual tendency to incline and rotate when compressed, thereby providing significantly enhanced structural stability in each direction within the spring assembly 26.

Figure 8:
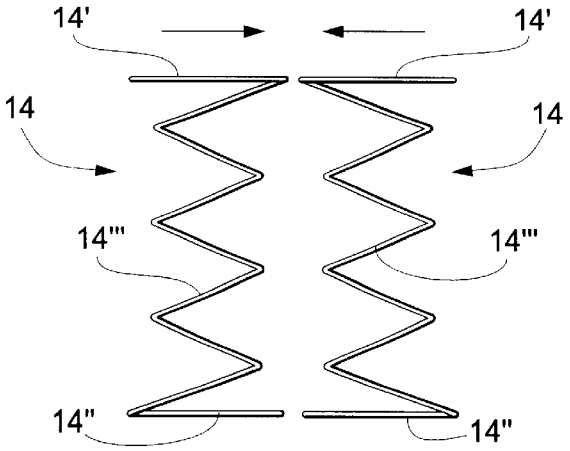
FIG. 8 is a schematic side elevational view of adjacent left-hand and right-hand spring coils within the mattress spring cushion assembly of FIG. 7, depicting the effect of the oppositely handed spring coils to counteract their respective tendencies to incline laterally when compressed.
Figure 9:
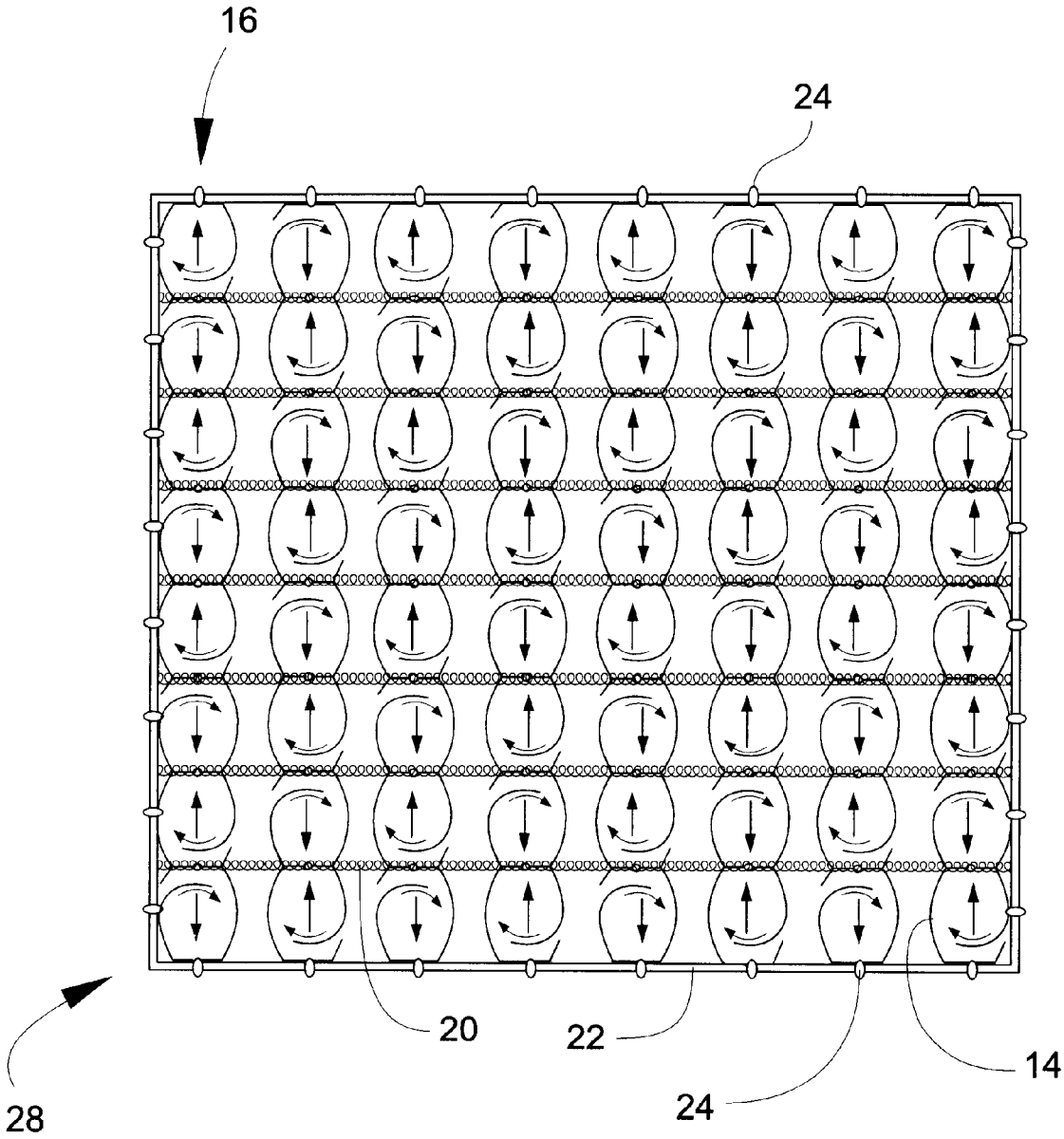
FIG. 9 is a schematic top plan view of a mattress spring cushion assembly according to an alternative embodiment of the present invention formed entirely of right-hand spring coils alternating and intervening ones of which within each row and column are disposed in opposing orientations rotated one hundred eighty degrees from one another.

While the embodiment of FIG. 8 utilizing both right-hand and left-hand spring coils will be preferred for various applications, it is also contemplated, however, that beneficial results and advantages may be achieved in accordance with the present invention in a spring cushion assembly formed entirely of spring coils of a common hand by arranging alternating and intervening spring coils in each row and column in opposing relative orientations or dispositions which will effectively counteract the tendency of each individual spring coil to incline when compressed. Such an alternative embodiment of a spring cushion assembly made entirely of right-hand spring coils is depicted in FIG. 9 generally at 28. In such embodiment, within each spring coil row 16, each alternating right-hand spring coil 14 is rotated one hundred eighty degrees with respect to each intervening spring coil 14 and the orientations of the spring coils 14 in adjacent rows 16 is staggered such that, within each spring coil column 18, each alternating right-hand spring coil 14 is likewise rotated one hundred eighty degrees with respect to each intervening spring coil 14. As with the embodiment of FIG. 7, this arrangement of the spring coils 14 effectively causes the spring coils 14 to act in direct opposition to one another both lengthwise along the columns 18 and widthwise across the rows 16 to counteract their individual tendency to incline when compressed, in the same manner as depicted in FIG. 8 and as also indicated by the arrows in FIG. 9, thereby providing enhanced structural stability in each direction within the spring assembly 26. While the spring coils in this embodiment do not serve to counteract the tendency of one another to rotate when compressed, the alternating orientations of the spring coils 14 in accordance with the present invention still effectively counteract their inclinational tendencies and provides significant performance improvements over the prior art.

While the present invention has been described herein with respect to a preferred embodiment in a mattress spring cushion assembly comprised of open-ended coil spring units, it will be recognized by persons skilled in the art and it is to be understood that the present invention is not so limited and, in particular, is contemplated to be equally applicable and beneficial in mattress spring cushion assemblies comprised of closed, i.e., knotted, coil spring units, as well as in spring cushion assemblies intended for use in other articles of furniture, whether or not the spring coils in such an assembly are integrated together via helical connector wires, border wires, or otherwise. Similarly, while the present invention has been described herein with respect to embodiments of spring cushion assemblies utilizing individual spring coil units, it will similarly be understood that the invention is contemplated to be equally applicable to spring cushion assemblies made with other forms of spring coils, e.g., so-called continuous coil units wherein a continuous length of wire is formed into multiple successive spring coils.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A spring cushion assembly comprising a plurality of spring coils aligned with one another in parallel linear spring coil rows and parallel linear spring coil columns perpendicular to the spring coil rows, each spring coil being of a configuration producing a tendency to incline laterally when compressed, each spring coil row and each spring coil column comprising spring coils oriented relative to one another to incline in opposing directions for counteracting the tendency of the spring coils to incline, at least selected ones of the spring coils comprising open end turns.

2. A spring cushion assembly according to claim 1, wherein the plurality of spring coils comprises a sub-plurality of right-hand spring coils and a sub-plurality of left-hand spring coils.

3. A spring cushion assembly according to claim 1, wherein, within each spring coil row and within each spring coil column, alternating spring coils are oriented to incline in a first direction and intervening spring coils are oriented to incline in a second direction in opposition to the first direction.

4. A spring cushion assembly according to claim 3, wherein the alternating and intervening spring coils are of opposing hands.

5. A spring cushion assembly according to claim 1, wherein each spring coil is of a configuration producing a tendency to rotate when compressed, each spring coil row and each spring coil column comprising spring coils oriented relative to one another to rotate in opposing directions for counteracting the tendency of the spring coils to rotate.

6. A spring cushion assembly according to claim 5, wherein, within each spring coil row and within each spring coil column, alternating spring coils are oriented to rotate in a first direction and intervening spring coils are oriented to rotate in a second direction in opposition to the first direction.

7. A spring cushion assembly according to claim 6, wherein the alternating and intervening spring coils are of opposing hands.

8. A spring cushion assembly according to claim 1, wherein the selected spring coils comprise open upper and lower end turns.

9. A spring cushion assembly according to claim 8, wherein each of the selected spring coils comprises a full number of coil turns between the open upper and lower end turns.

10. A spring cushion assembly according to claim 8, wherein each spring coil comprises an open upper end turn and an open lower end turn.

11. A spring cushion assembly according to claim 10, wherein each spring coil comprises a full number of coil turns between the open upper and lower end turns.

12. A spring cushion assembly according to claim 1, further comprising a perimeter border wire disposed outwardly about the plurality of spring coils and connected to selected ones thereof, and a plurality of connector wires extending between selected adjacent rows or selected adjacent columns and connected to the spring coils thereof for integrating the pluralities of spring coils together.

13. A spring cushion assembly according to claim 12, wherein each spring coil comprises an upper end turn and a lower end turn, the upper end turns of the plurality of spring coils being essentially co-planar with one another and the lower end turns of the plurality of spring coils being essentially co-planar with one another, and further comprising upper and lower perimeter border wires respectively disposed outwardly about and connected to selected ones of the co-planar upper and lower end turns of the plurality of spring coils, and upper and lower connector wires extending between selected adjacent rows or selected adjacent columns and connected respectively to the upper and lower end turns of the spring coils thereof.

14. A spring cushion assembly according to claim 12 or 13, wherein the connector wires are helical.

15. A spring cushion assembly according to claim 13, wherein the upper and lower end turns are open and each of the spring coils comprises a full number of coil turns between the open upper and lower end turns thereof.

16. A spring cushion assembly according to claim 12, 13 or 15, wherein the spring cushion assembly is a mattress spring assembly.

17. A spring cushion assembly comprising a plurality of spring coils aligned with one another in parallel linear spring coil rows and parallel linear spring coil columns perpendicular to the spring coil rows, each spring coil being of a configuration producing a tendency to incline laterally when compressed, each spring coil row and each spring coil column comprising spring coils oriented relative to one another to incline in opposing directions for counteracting the tendency of the spring coils to incline, a perimeter border wire disposed outwardly about the plurality of spring coils and connected to selected ones thereof, and a plurality of connector wires extending between selected adjacent rows or selected adjacent columns and connected to the spring coils thereof for integrating the pluralities of spring coils together.

18. A spring cushion assembly according to claim 17, wherein each spring coil comprises an upper end turn and a lower end turn, the upper end turns of the plurality of spring coils being essentially co-planar with one another and the lower end turns of the plurality of spring coils being essentially co-planar with one another, and further comprising upper and lower perimeter border wires respectively disposed outwardly about and connected to selected ones of the co-planar upper and lower end turns of the plurality of spring coils, and upper and lower connector wires extending between selected adjacent rows or selected adjacent columns and connected respectively to the upper and lower end turns of the spring coils thereof.

19. A spring cushion assembly according to claim 17 or 18, wherein the connector wires are helical.

20. A spring cushion assembly according to claim 18, wherein the upper and lower end turns are open and each of the spring coils comprises a full number of coil turns between the open upper and lower end turns thereof.

21. A spring cushion assembly according to claim 17, 18 or 20, wherein the spring cushion assembly is a mattress spring assembly.

* * * * *

US006375169C1

(12) INTER PARTES REEXAMINATION CERTIFICATE (0106th)

United States Patent
McCraw et al.

(10) Number: US 6,375,169 C1
(45) Certificate Issued: Oct. 13, 2009

(54) MATTRESS SPRING CUSHION ASSEMBLY WITH COMBINATION OF RIGHT-HAND AND LEFT-HAND SPRING UNITS

(75) Inventors: Kevin N. McCraw, Micaville, NC (US); Stuart Spiller, Sheboygan, WI (US)

(73) Assignee: Hickory Springs Manufacturing Company, Hickory, NC (US)

Reexamination Request:
No. 95/000,010, Mar. 12, 2003

Reexamination Certificate for:

| | |
|---|---|
| Patent No.: | **6,375,169** |
| Issued: | **Apr. 23, 2002** |
| Appl. No.: | **09/627,621** |
| Filed: | **Jul. 28, 2000** |

(51) Int. Cl.
*F16F 13/00* (2006.01)

(52) U.S. Cl. ..... 267/75; 267/93; 267/97; 5/248

(58) Field of Classification Search ..... None
See application file for complete search history.

(56) References Cited

U.S. PATENT DOCUMENTS

| | | | |
|---|---|---|---|
| 114,618 | A | 5/1871 | Speckner |
| 349,310 | A | 9/1886 | Keene |

*Primary Examiner*—Matthew C. Graham

(57) ABSTRACT

A spring cushion assembly, particularly for mattresses, comprises a plurality of spring coils aligned with one another in parallel linear spring coil rows and parallel linear spring coil columns perpendicular to the spring coil rows, each spring coil being of a configuration producing a tendency to incline laterally when compressed, with each spring coil row and each spring coil column comprising spring coils oriented relative to one another to incline in opposing directions for counteracting the tendency of the spring coils to incline.

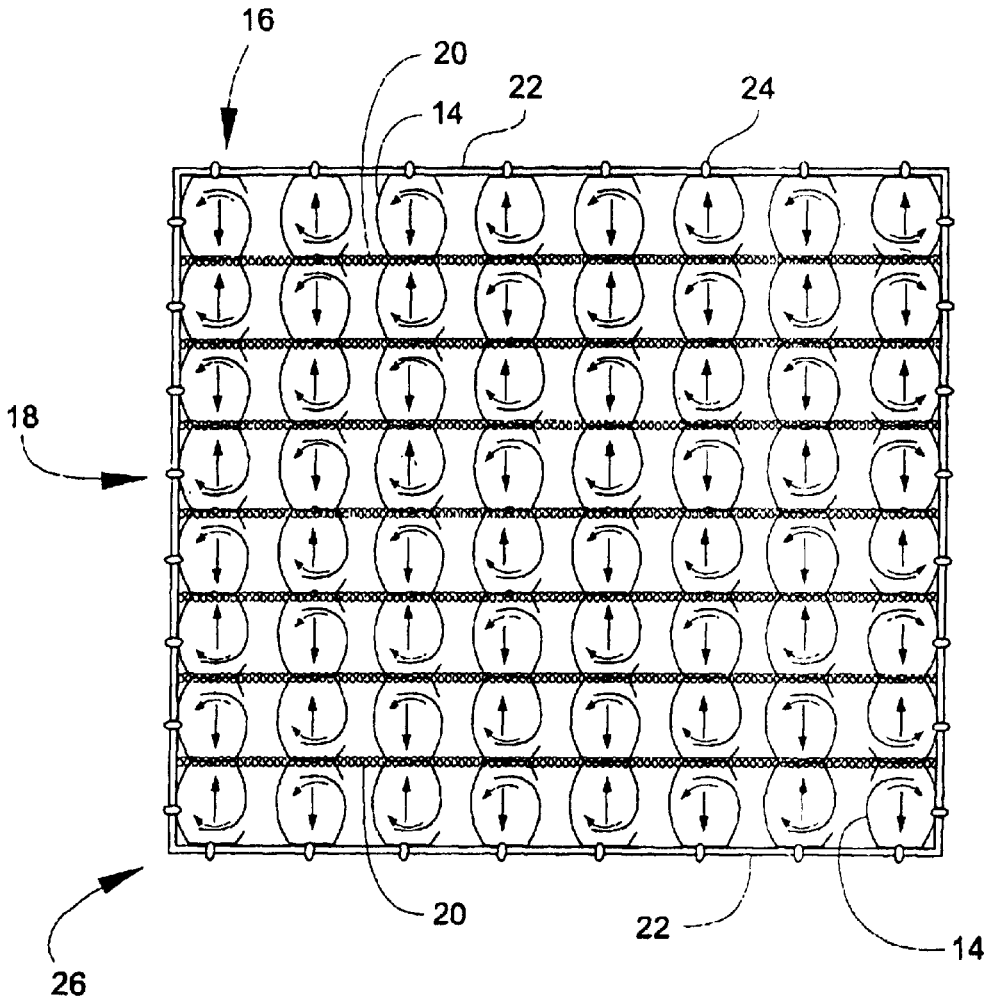

INTER PARTES REEXAMINATION CERTIFICATE ISSUED UNDER 35 U.S.C. 316

NO AMENDMENTS HAVE BEEN MADE TO THE PATENT

AS A RESULT OF REEXAMINATION, IT HAS BEEN DETERMINED THAT:

The patentability of claims 1–21 is confirmed.

* * * * *